US007004780B1

(12) United States Patent
Wang

(10) Patent No.: US 7,004,780 B1
(45) Date of Patent: Feb. 28, 2006

(54) PORTABLE COMPUTER PERIPHERAL APPARATUS WITH RETRACTABLE PLUG CONNECTOR

(75) Inventor: Kuang-Yu Wang, Saratoga, CA (US)

(73) Assignee: Super Talent Electronics, Inc., San Jose, CA (US)

( * ) Notice: Subject to any disclaimer, the term of this patent is extended or adjusted under 35 U.S.C. 154(b) by 0 days.

(21) Appl. No.: 10/845,653

(22) Filed: May 13, 2004

(51) Int. Cl.
*H01R 13/627* (2006.01)

(52) U.S. Cl. ..... 439/353; 360/100; 361/752; 710/74

(58) Field of Classification Search ..... 439/353, 439/131, 350; 710/74; 361/752; 360/100
See application file for complete search history.

(56) References Cited

U.S. PATENT DOCUMENTS

| | | | | |
|---|---|---|---|---|
| 4,833,554 | A * | 5/1989 | Dalziel et al. | 360/98.04 |
| 6,456,500 | B1 * | 9/2002 | Chen | 361/752 |
| 6,480,390 | B1 * | 11/2002 | Matsumiya et al. | 361/736 |
| 6,618,243 | B1 | 9/2003 | Tirosh | 361/683 |
| 6,743,030 | B1 * | 6/2004 | Lin et al. | 439/131 |
| 6,763,410 | B1 * | 7/2004 | Yu | 710/74 |
| D494,969 | S * | 8/2004 | Lin | D14/356 |
| 6,792,487 | B1 * | 9/2004 | Kao | 710/74 |
| 6,808,400 | B1 * | 10/2004 | Tu | 439/131 |
| 2003/0100203 | A1 | 5/2003 | Yen | 439/79 |

* cited by examiner

*Primary Examiner*—Michael C. Zarroli
(74) *Attorney, Agent, or Firm*—Bever, Hoffman & Harms, LLP; Patrick T. Bever

(57) ABSTRACT

A computer peripheral device including a positioning mechanism for deploying and retracting a USB plug connector. The connector is retracted and locked into the housing while not in use. The housing provides protection from potential damage to the connector due to external contact. The positioning mechanism includes a handle that can be pressed down, slid along the housing surface, and locked into position to expose the plug connector when data transfer to and from the host is needed. The reverse motion will retract and secure the connector/PCBA to be locked completely inside the housing. The mechanism is engaged with features built in the housing to provide locking and unlocking functions. The engagement mechanism can be exposed or hidden from view. The mechanism can be mounted on top or side surfaces of the housing of the USB pen drive. Several design options are disclosed.

18 Claims, 11 Drawing Sheets

170
168
118
100-1
110-1
112
150
151
152

170
163
133
166
160
168
136
165
161
137B
135
137A
153
130
140
150
120
131
152
151

114
113
100-1
118
110-1
115
111
117A
112
116
117B
118
168
100-1
110-1
112
152
150
151

PORTABLE COMPUTER PERIPHERAL APPARATUS WITH RETRACTABLE PLUG CONNECTOR

FIELD OF THE INVENTION

The present invention relates to computer peripheral devices and, in particular, it concerns a pocket-size computer peripheral devices that are connected with host computer systems by way of plug connectors.

BACKGROUND OF THE INVENTION

In the field of computers and computer peripheral devices, there is an ongoing trend towards miniaturization for convenience and portability. In certain cases, devices have been reduced to "pocket size", meaning that they can literally be carried in a user's pocket in the same manner as a wallet or set of keys.

One example of particular interest, in which context the present invention will be described herein, is a "flash disk", or "USB flash drive". For example, one product includes a pen-type flash device having a USB connector plug that can be connected to a USB port of a standard computer. The USB plug connector is protected by a removable cover when not in use.

A problem with convention pen-type peripheral devices is that the removable cover can become inadvertently lost while the device is in use, thereby leaving the USB plug connector exposed to damage or contamination.

What is needed is a pen-type portable computer peripheral device that overcomes the problems associated with conventional structures.

SUMMARY

The present invention is directed to a pen-type portable computer peripheral device (apparatus) that includes a plug connector (e.g., a USB plug connector) that is manually movable between a retracted position, in which the plug connector is positioned inside of the housing, and a deployed position in which the plug connector extends through the opening and is exposed outside of the housing. By maintaining the plug connector in the retracted position whenever the peripheral device is disconnected from a host system, the present invention provides a convenient means for protecting the plug connector from damage and contamination without the need for a removable cap, which can be lost.

According to an embodiment of the present invention, a portable computer peripheral device includes a housing having upper, lower, and side walls forming a generally rectangular cross-section defining an elongated chamber having a front end opening. At least one of the upper and side walls defines a slot extending in the longitudinal direction. A rigid substrate (e.g., a PCB) is slidably mounted in a positioning groove defined by the housing. A plug connector is mounted on a front end of the substrate, and a positioning member is mounted on the substrate and includes a handle structure that partially extends through the slot formed in the upper surface. In one specific embodiment, the slot is defined in the upper wall of the housing, and the positioning member is mounted on an upper surface of the substrate. In another specific embodiment, the slot is defined in a side wall of the housing, and the positioning member is mounted on a side edge of the substrate. In either case, pushing the handle structure along the slot moves the plug connector (by way of the rigid substrate) between the retracted and deployed positions.

According to an aspect of the invention, the positioning member is a bendable cantilever-type structure having one or more locking structures (e.g., protrusions) formed thereon, and one or more additional locking structures (e.g., grooves) are provided on the housing to facilitate locking the plug connector in the retracted and/or deployed positions. The cantilever-type positioning member includes a base fixedly attached to the substrate (PCB), and a free end that is spaced from the substrate. The handle structure and first locking structure extend from an upper surface of the position member near the free end. When the plug connector is in the retracted position, the locking structure extending from the positioning member engages a second locking structure provided on the housing, thereby preventing inadvertent deployment of the plug connector. To subsequently deploy the plug connector, the handle structure is pressed into the housing, thereby causing the free end of the cantilever-like structure to bend, and causing the locking structure extending from the positioning member to disengage from the housing. The handle structure is then pushed along the slot while pressing downward until the plug connector is fully deployed (i.e., the handle structure is located at the forward end of the slot). The handle structure is then released, causing the free end of the cantilever structure to resiliently bend upward (i.e., away from the underlying substrate), and causing a locking structure (or the same locking structure) on the positioning member to engage a third locking structure provided on the housing, thereby locking the plug connector in the deployed position.

According to another embodiment of the present invention, a method for manufacturing pen-type computer peripheral devices includes manufacturing a PCBA including a plug connector, IC devices and other components mounted onto a PCB, and also manufacturing (e.g., plastic molding) a positioning member having a handle structure, a housing defining a front opening and a slot, and one or more end caps (if needed). The positioning member is mounted onto the PCBA, and then the positioning member is inserted into the housing such that a portion of the handle structure extends through the slot, and the plug connector is positioned adjacent to the front opening of the housing, whereby manual movement of the handle structure along the slot causes the plug connector to move between a retracted position, in which the plug connector is positioned inside of the housing, and a deployed position in which the plug connector extends through the front opening and is exposed outside of the housing. An optional cap or caps are then secured onto the ends of the housing.

In accordance with alternative embodiments of the present invention, the housing includes two or more portions that are assembled over the PCBA. In one specific embodiment, the PCBA is mounted into a rear housing portion such that the PCBA extends from a front opening thereof, and then a front housing portion is mounted onto the rear housing portion over the front end of the PCBA (e.g., over the plug connector), thereby eliminating the need for a rear cap. In another specific embodiment, the PCBA is mounted into a lower (base) housing portion, then a top cover is mounted onto the base housing portion, and a pair of end caps are mounted onto the respective ends to secure the base portion and top cover.

In accordance with another alternative embodiment of the present invention, a pen-type computer peripheral device includes a housing having the slot defined along one of the side (i.e., shorter) walls of the generally rectangular cross-section, and a modified positioning member includes a base portion mounted on side edge of the PCBA such that a handle portion extends through the slot. The resulting structure is somewhat wider than embodiments in which the positioning member is mounted on the surface of the PCB, but the resulting structure facilitates a flatter profile.

In accordance with yet another alternative embodiment, an externally exposed locking mechanism is provided that facilitates visual confirmation that the device is secured in the retracted and/or deployed position, thereby preventing accidental retraction or deployment that could result in damage to the plug connector. In one embodiment, an H-shaped protrusion is provided on the upper surface of the positioning member that alternately engages H-shaped openings located at opposite ends of the positioning slot. When the plug connector is in the retracted position, the cantilever-type positioning member biases the H-shaped protrusion into the rearmost H-shaped opening. To deploy the plug connector, the handle structure, which extends from an upper surface of the H-shaped protrusion, is pressed downward and slid along the slot until the H-shaped protrusion aligns with the front-most H-shaped opening. The pressing force is then release, and the H-shaped protrusion is resiliently biased into the front-most H-shaped opening. In alternative embodiments, the legs of the H-shaped protrusion are located at ends of the handle structure, or extend from the sides of the handle structure. In another embodiment, an H-shaped key structure is formed from the cantilever structure.

According to yet another embodiment of the present invention, a positioning member includes curved support members that extend from the base and contact the upper surface of the PCB to minimize the torque applied by the base to the PCB, thereby reducing costs and overall size by facilitating the use of thinner PCBs.

BRIEF DESCRIPTION OF THE DRAWINGS

These and other features, aspects and advantages of the present invention will become better understood with regard to the following description, appended claims, and accompanying drawings, where:

DETAILED DESCRIPTION OF THE DRAWINGS

The present invention is directed to pocket-sized, portable computer peripheral devices that are connected by plug connectors (e.g., USB plug connectors) to host computer systems to perform various functions. While the present invention is depicted in particular as a pen-type peripheral (i.e., USB flash drive) device, it should be appreciated that the present invention is applicable to any and all pocket-sized computer peripheral device types that are readily transportable and which may be advantageously interconnected with various host computer systems. Examples of such portable computer peripheral devices include, but are not limited to, flash memory and other data storage devices, communications devices, scanners and cameras. The term "host computer system" is used herein to refer to any electronic computer of any type or size including, but not limited to, desktop computers (PC, Mac or other), notebook computers, palmtop computers and personal digital assistant (PDA) devices.

Figures 1, 2A, 2B:
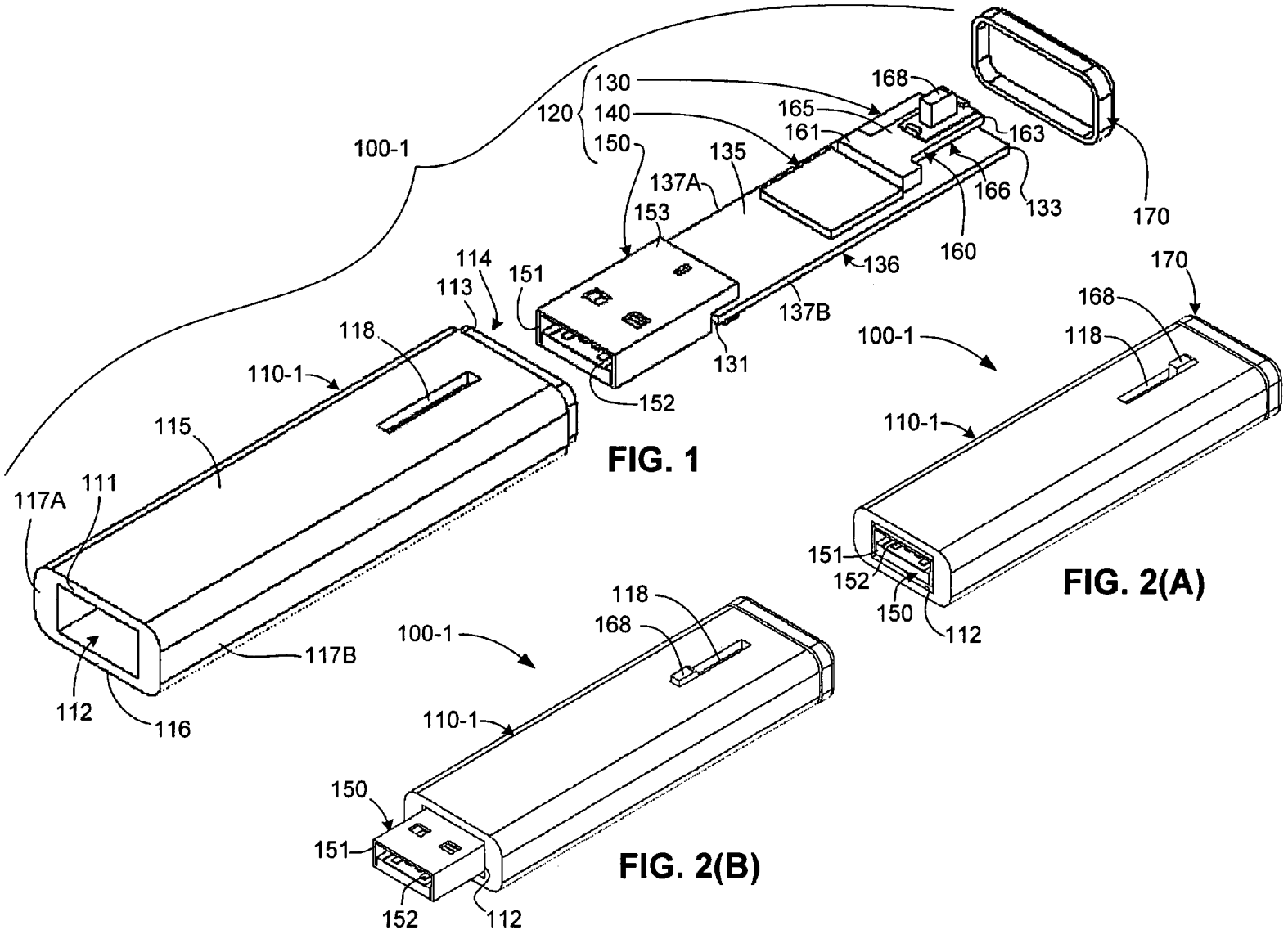
FIG. 1 is an exploded perspective view showing a pen-type computer peripheral device according to an embodiment of the present invention.
FIGS. 2(A) and 2(B) are perspective views showing the peripheral device of FIG. 1 in alternative closed and open positions, respectively.

FIG. 1 is an exploded perspective view showing a pen-type (i.e., retractable) computer peripheral device 100-1 according to a first embodiment of the present invention. Device 100-1 generally includes a housing 110-1, a printed circuit board assembly (PCBA) 120 that is mounted inside of housing 110-1, a manual (press-slide) positioning member 160 mounted on PCBA 120, and an optional rear cap 170.

Referring to the left side of FIG. 1, housing 110-1 generally includes a front (first) end portion 111 that defines a front opening 112, a back (second) end portion 113 that defines a rear opening 114, an elongated upper wall 115, an elongated lower wall 116, and opposing elongated side walls 117A and 117B that extend between side edges of upper wall 115 and lower wall 116. Upper wall 115, a lower wall 116, and side walls 117A and 117B are arranged as indicated to form a generally rectangular cross-section that defines an elongated chamber extending in a longitudinal direction between front opening 112 and rear opening 114. In addition, one of the walls (i.e., in this embodiment, upper wall 115) defines a slot 118 that extends in the longitudinal direction for reasons that will become clear below. Back end portion 113 defines a mounting structure for snap coupling rear cap 170, thereby closing off rear opening 114 after PCBA 120 is inserted therethrough.

Referring to the central portion of FIG. 1, PCBA 120 includes a printed circuit board (PCB) 130, at least one integrated circuit (IC) device (electronic device) 140, and a plug connector 150 that are assembled as described below.

PCB 130 is fabricated using standard PCB manufacturing techniques, and, according to an aspect of the present invention, is slidably mounted within the elongated chamber defined by housing 110-1 in the manner described below. PCB 130 has a front edge 131 that is located adjacent to front opening 112 and a back edge 133 that is located adjacent to rear opening 113 when PCBA 120 is mounted in housing 110-1. PCB 130 has opposing upper and lower surfaces 135 and 136 that define a width (i.e., extending between opposing side edges 137A and 137B) that is sized to slidably fit within housing 110-1.

At least one IC device 140 and/or other electronic component are mounted on or otherwise electrically connected to PCB 120 (e.g., on upper surface 135 and/or lower surface 136) according to well-established techniques to form an electronic circuit. IC device 140 and associated other electronic components (not shown) that are mounted on PCB 130 may be selected to perform a variety of computer peripheral functions, such as those mentioned above.

Plug connector 150 is mounted onto front end 131 of PCB 130 such that a socket opening 151 of plug connector 150 faces away from PCB 130, and connection pins 152 located inside socket opening 151 are generally aligned in the longitudinal direction defined by housing 110-1. In the disclosed embodiment, plug connector 150 is a Universal Serial Bus (USB) plug connector that is electrically connected to IC device 140 through contacts and conductive traces (not shown) that are formed on PCB 130 using known techniques.

Referring to the rear portion of PCBA 120 (FIG. 1), manual positioning member 160 is a cantilever structure including a base portion (first end) 161 that is mounted to substrate 130, a free (second) end 163 that extends over upper surface 135 of PCB 130, an upper surface 165 that faces away from PCB 130, and a lower surface 166 that faces PCB 130. Positioning member 160 also includes a handle structure 168 that is mounted adjacent to free end 163, and extends upward from upper surface 165 (i.e., away from PCB 130).

According to another aspect of the present invention, when PCBA 120 is mounted inside housing 110, manual positioning member 160 provides a mechanism for manually moving plug connector 150 between a closed (first) position, in which plug connector 150 is fully retracted inside housing 110-1 (e.g., as depicted in FIG. 2(A)), and a deployed (second) position in which plug connector 150 extends through front opening 112 and is exposed outside of housing 110-1 for connection to an unillustrated host system (e.g., as depicted in FIG. 2(B)). In particular, as indicated in FIG. 2(A), when the PCBA is mounted inside of housing 110-1, a portion of handle structure 168 is exposed through slot 118 such that it can be manually pushed or otherwise moved by a user in the direction defined by slot 118 (i.e., the longitudinal direction defined by housing 110-1). Because the positioning member is fixedly connected to plug connector 150 (i.e., by way of the rigid PCB substrate), the retracted/exposed position of plug connector 150 can be manually changed by the user by way of the exposed portion of handle structure 168. For example, as indicated in FIG. 2(A), when handle structure 168 is manually positioned at a rear end of slot 118, plug connector 150 is retracted inside housing 110-1, thereby protecting plug connector 150 when not in use. Conversely, as indicated in FIG. 2(B), when a user wishes to connect peripheral device 100-1 to a host system (not shown), the user pushes the exposed portion of handle 168 to the front end of slot 118, thereby displacing PCBA relative to housing 110-1 such that plug connector 150 extends through front opening 112. The exposed plug connector 150 can then be connected to a corresponding plug structure provided on the host system to facilitate data communication between peripheral device 100-1 and the host system utilizing known communication techniques. Upon completing the data communication operation, peripheral device 100-1 is disengaged from the host system, and plug connector 150 is manually retracted back into housing 110-1 by moving handle structure 168 back into the position shown in FIG. 2(A). Accordingly, the present invention provides a pen-type computer peripheral device in which the plug connector is protected when not in use without the need for a removable cover, as utilized in conventional arrangements.

Figure 3A:
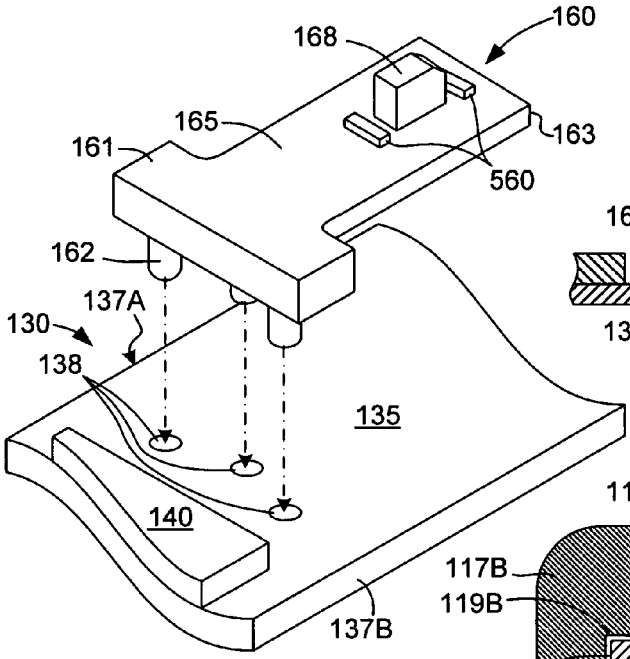
FIGS. 3(A) and 3(B) are exploded perspective and cross-sectional side views showing a cantilever-like locking member of the peripheral device of FIG. 1.
Figure 3B:
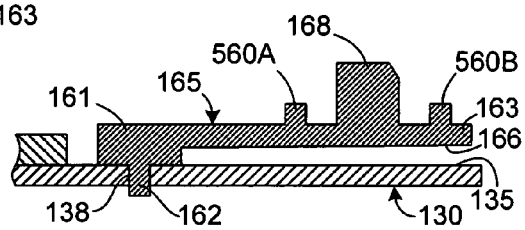

FIGS. 3(A) and 3(B) are exploded perspective and cross-sectional side views, respectively, showing cantilever-type positioning member 160 and a portion of PCB 130 in additional detail. As indicated in FIG. 3(A), PCB 130 includes several through holes 138 that extend into upper surface 135, and positioning member 160 further includes several pin-like connection posts 162 extending downward from base portion 161. As indicated in FIG. 3(B), when positioning member 160 is mounted on PCB 130, connection posts 162 are received in through holes 138, thereby securing base portion 161 to substrate 130. In one embodiment, connection posts 162 are slightly larger than holes 138, thereby facilitating interference (press) fitting engagement. In another embodiment, a suitable adhesive, ultrasonic welding, or another attachment mechanism is utilized to secure the connection between base portion 161 and substrate 130. Note that, as indicated in FIG. 3(B) a portion of lower surface 166 of positioning member 160 that is located adjacent to free end 163 has clearance from (i.e., spaced from) upper surface 135 of PCB 130. The purpose for this offset will become clear below.

Figure 4:
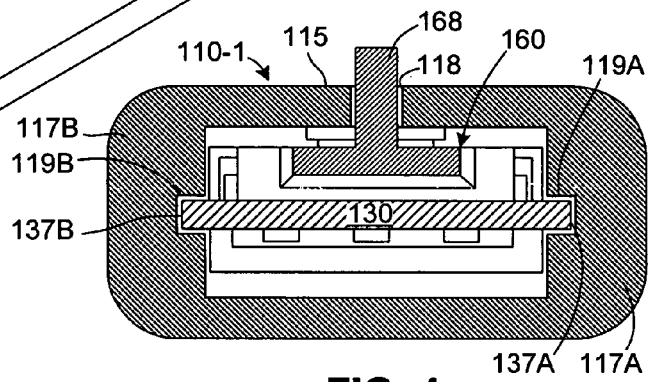
FIG. 4 is a cross-sectional end view showing the cantilever of FIG. 3(A) mounted inside of a housing of the peripheral device of FIG. 1.

FIG. 4 is a cross-sectional end view showing housing 110-1, PCB 130 and handle structure 168 of positioning member 160. According to an aspect of the first embodiment, each side wall 117A and 117B of housing 110-1 defines an inner groove 119A and 119B, respectively, that slidably receives side edges 137A and 137B, respectively. The height of grooves 119A and 119B is slightly larger than the thickness of PCB 130, thereby facilitating sliding movement of PCB 130 in the longitudinal direction (i.e., into and out of the sheet). During this sliding movement of PCB 130, handle structure 168 is also constrained to slide in the longitudinal direction by slot 118. Note that the width of handle structure 168 is slightly narrower than the width of slot 118, thus allowing handle structure 168 to slide freely along the longitudinal direction.

Figure 5A:
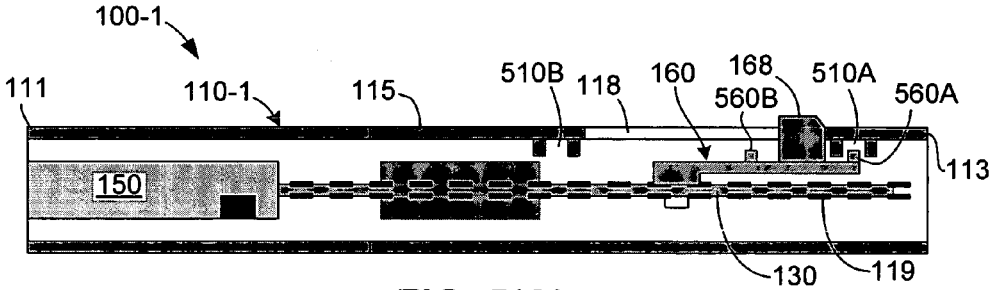
FIGS. 5(A) and 5(B) are simplified cross-sectional side views showing the peripheral device of FIG. 1 in alternative open and closed positions.
Figure 5B:
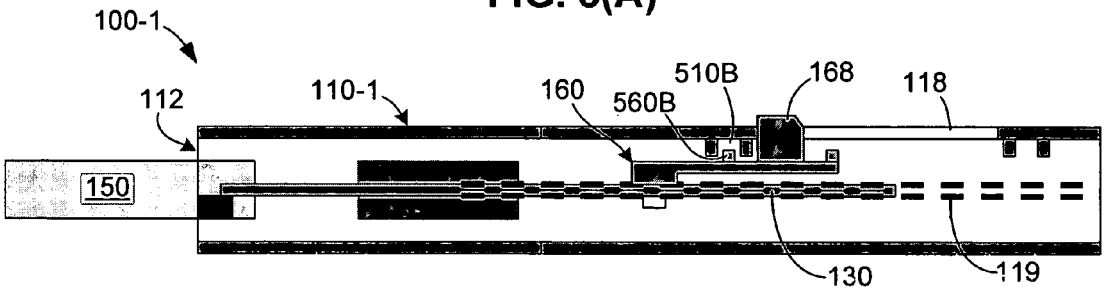

FIGS. 5(A) and 5(B) are simplified cross-sectional side views showing a portion of peripheral device 100-1 in additional detail. FIG. 5(A) depicts peripheral device 100-1 in the retracted position, which is achieved by press-sliding handle structure 168 of positioning member 160 to the end of slot 118 that is adjacent to back end 113, thereby moving PCB 130 to the rightmost end of groove 119, and retracting plug connector 150 inside housing 110-1. FIG. 5(B) depicts peripheral device 100-1 in the deployed position, which is achieved by sliding handle structure 168 of positioning member 160 to the left end of slot 118, thereby moving PCB 130 to the left along groove 119, and pushing plug connector 150 through opening 112 housing 110-1.

According to another aspect of the present invention, peripheral device 100-1 further includes a locking mechanism for securing the plug connector in the deployed and retracted positions. As depicted in FIGS. 5(A) and 5(B), in one embodiment the locking mechanism includes locking protrusions (first locking structures) 560A and 560B located next to positioning handle 168 on positioning member 160, and locking grooves (second and third locking structures) 510A and 510B which are defined on a bottom (inside) surface of upper wall 115. As indicated in FIG. 5(A), locking grooves 510A and 510B are located at opposite ends of slot 118, with groove 510A located at the end of slot 118 located adjacent to back end 113 of housing 110-1. As depicted in FIGS. 3(A) and 3(B), locking protrusions 560A and 560B are, in the present embodiment, bar-like structures located on opposite sides of positioning handle 168. Bar-like locking protrusions 560A and 560B are wider than the width of slot 118, thus preventing positioning member 160 from accidentally traveling vertically through the slot 118. Referring again to FIG. 5(A), when plug connector 150 is retracted, locking protrusion 560A engages locking groove 510A, thereby securing positioning member 160 such that handle structure 168 is secured to housing 110-1 at the right end of slot 118, thus preventing unintended deployment of plug connector 150. Conversely, referring again to FIG. 5(B), when plug connector 150 is fully deployed, locking protrusion 560B engages locking groove 510B, thereby securing positioning member 160 such that handle structure 168 is secured at the left end of slot 118, thus preventing unintended retraction of plug connector 150. Note that by locating locking grooves on the inside surface of upper wall 115, the area needed for slot 118 is minimized, thus minimizing the chance of contaminants (e.g., dust) entering housing 110-1. Further, the locking mechanism is hidden from a user's view, and is not subjected to human touch.

Figure 6A:
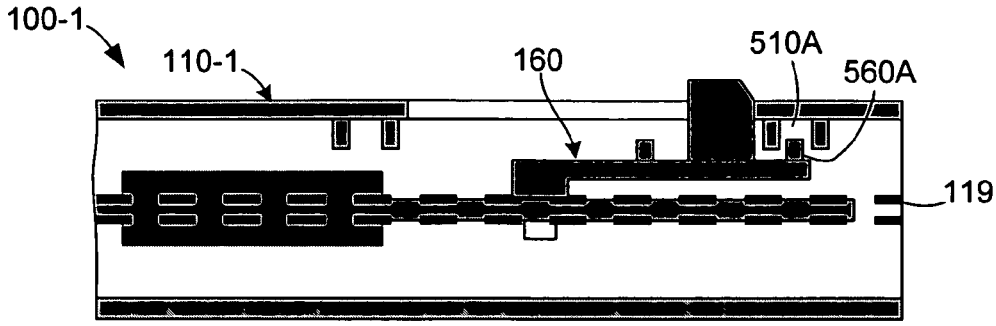
FIGS. 6(A), 6(B), 6(C), and 6(D) are simplified cross-sectional side views showing a portion of the peripheral device of FIG. 1 during operation.
Figure 6B:
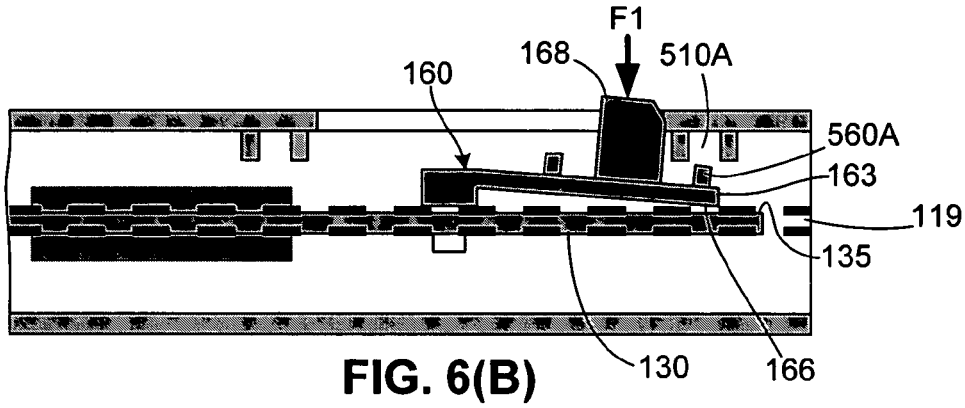
Figure 6C:
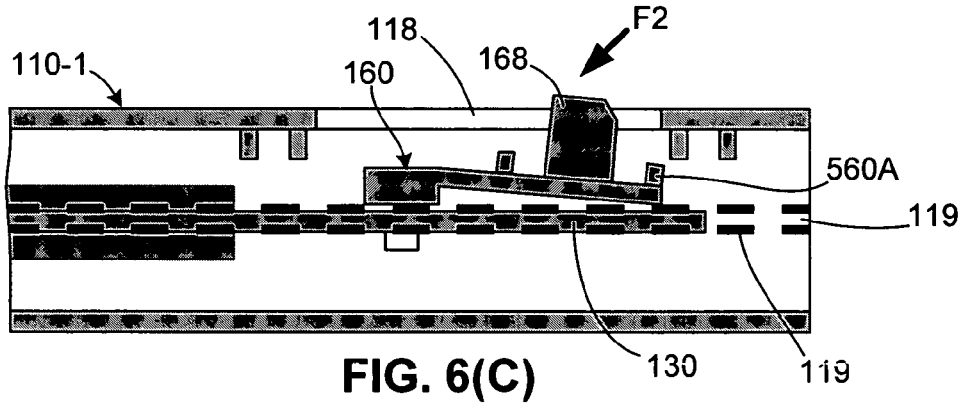
Figure 6D:
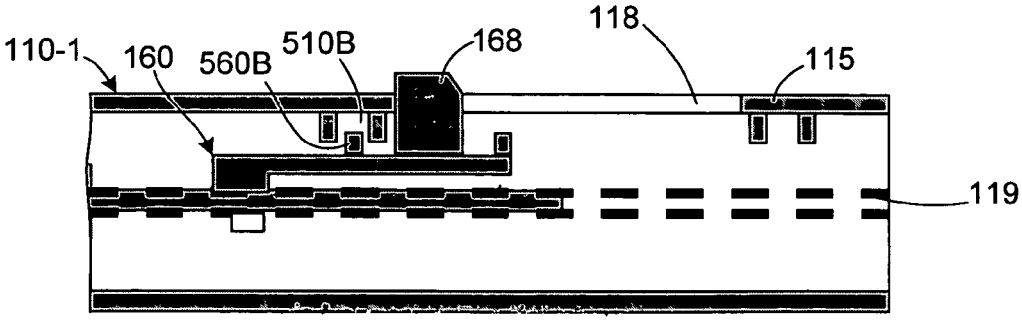

FIGS. 6(A) through 6(D) are cross-sectional side views showing a portion of peripheral device 100-1 during a manual positioning operation in which the plug connector (not shown) is deployed from the closed (retracted) position (e.g., shown in FIG. 5(A)) into the deployed position (e.g., shown in FIG. 5(B)). FIG. 6(A) shows positioning member 160 in the fully retracted position inside housing 110-1, with locking protrusion 560A engaged in locking groove 510A. As indicated in FIG. 6(B), a downward force F1 applied to handle structure 168 bends free end 163 of positioning member 160 downward, causing lower surface 166 to move closer to upper surface 135 of PCB 130, and causing locking protrusion 560A to disengage from locking groove 510A. Note that vertical displacement of PCB 130 is constrained by positioning groove 119 (which represents opposing grooves 119A and 119B, shown in FIG. 4(A)), thereby restricting movement of PCB 130 to the longitudinal direction. As indicated in FIG. 6(C), with locking protrusion 560A disengaged, a forward/downward (press-slide) force F2 on handle structure 168 is transferred to PCB 130, causing PCB 130 to slide along positioning groove 119, and thus causing the plug connector (not shown) to extend through the front opening of housing 110-1. Finally, as indicated in FIG. 6(D), when handle structure 168 is located at the leftmost end of slot 118, the downward/forward force is released, positioning member 160 resiliently bends back toward upper wall 115 of housing 110-1, thereby causing locking protrusion 560B to engage locking groove 510B. Subsequent retraction of the plug connector involves a similar but reversed operation to that depicted in FIGS. 6(A) to 6(D).

Figure 7:
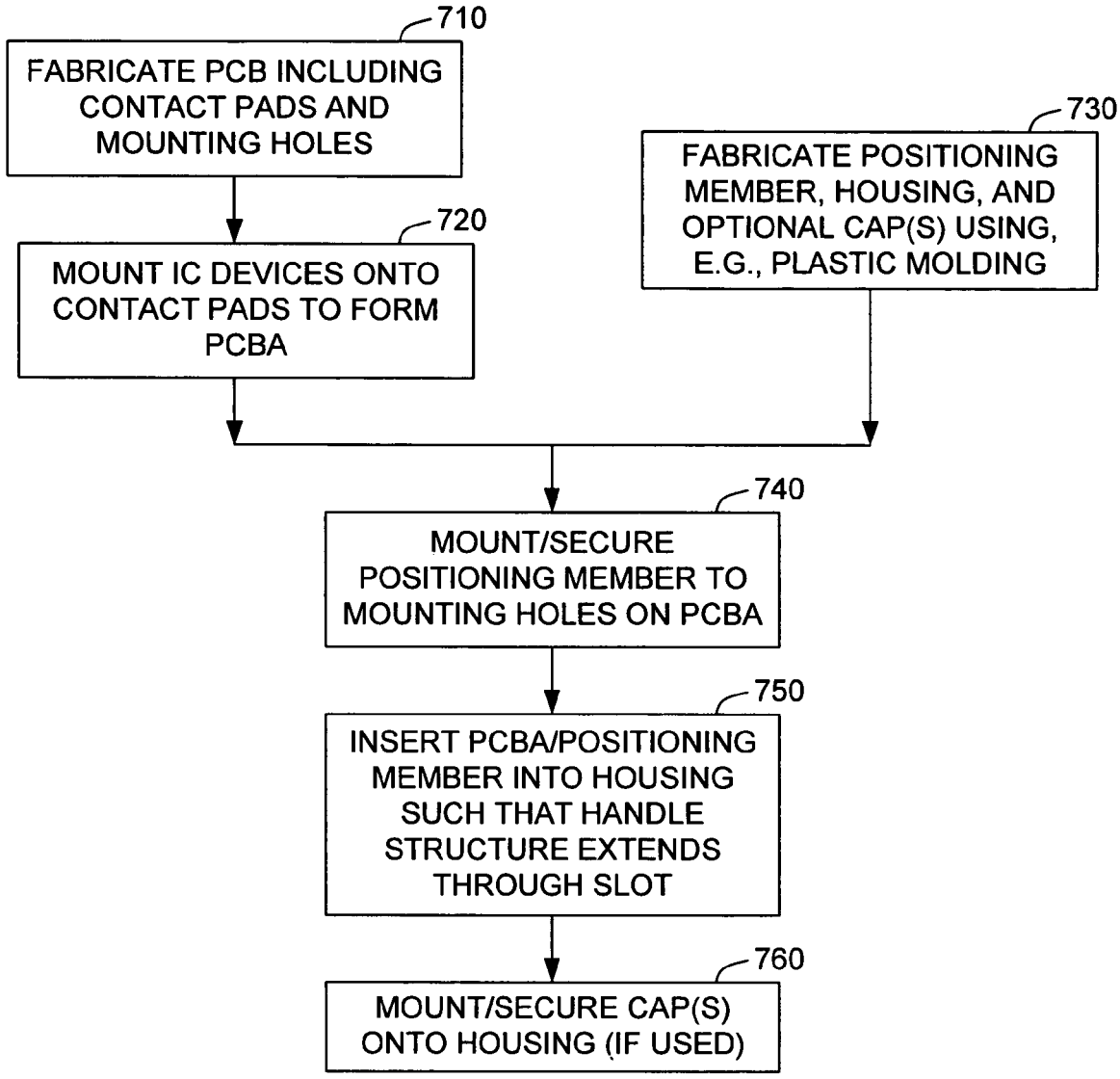
FIG. 7 is a flow diagram showing a method for manufacturing the peripheral device of FIG. 1 according to another embodiment of the present invention.

FIG. 7 is a flow diagram depicting a method for manufacturing pen-type computer peripheral devices according to another embodiment of the present invention. First, a PCB is manufactured according to known PCB fabrication techniques (block 710), and then a plug connector, IC devices and other components are mounted onto the PCB to form a PCBA (block 720). In one embodiment, the PCB is fabricated with mounting holes for mounting a positioning member (e.g., through-holes 138 are formed in PCB 130; see FIG. 3(A)), and the fully assembled PCBA includes the plug connector at one end of the PCB (e.g., see PCBA 120, FIG. 1). Concurrent with, before, or after the fabrication of the PCB, a positioning member, a housing, and one or more end caps (if needed) are fabricated using, for example, well-known plastic molding techniques (block 730). In one embodiment, the positioning member is formed with engaging structure (e.g., connection posts 162 of positioning member 160; FIG. 3(A)) that mates with the mounting holes formed on the associated PCB. With the components fabricated in this manner, the positioning member is then mounted or otherwise secured to the PCB such that the engaging structures of the positioning member are engaged with the mounting holes formed on the PCB (block 740). For example, as indicated in FIGS. 3(A) and 3(B), connection posts 162 are aligned with and inserted into through-holes 138, thereby securing positioning member 160 onto PCB 130. Next, the PCBA and positioning member assembly is inserted into the housing such that the handle structure of the positioning member protrudes through the slot (block 750). In one embodiment, the PCBA is inserted such that the side edges of the PCB are slidably received in positioning grooves formed in the side walls of the housing, as indicted in FIG. 4. Finally, the one or more end caps (if used) are mounted onto the end(s) of the housing (block 760), thereby completing the manufacturing process.

While the present invention has been described to this point with reference to one specific embodiment, several alternative structures are possible. Some of these alternative structures are incorporated into several exemplary embodiments, which are described below with reference to FIGS. 8–21. Like reference numerals in these alternative embodiments denote the same or similar structures described above. Note that these alternative structures are intended to be exemplary, and not limiting.

Figure 8:
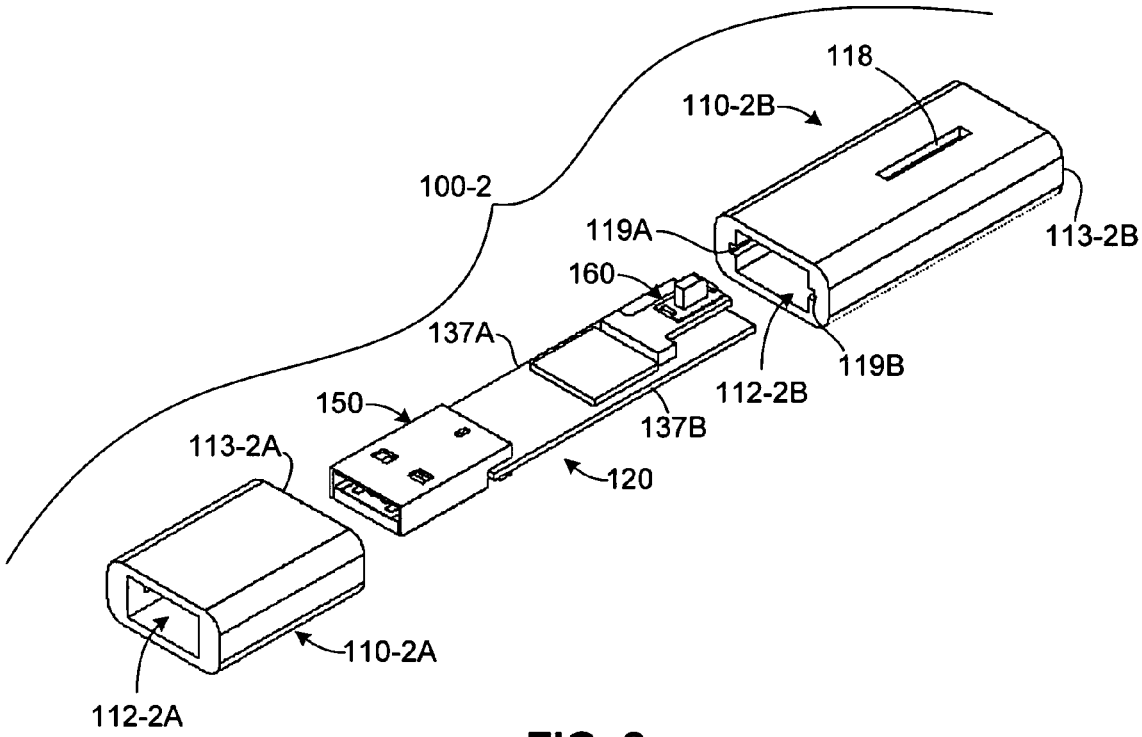
FIG. 8 is an exploded perspective view showing a pen-type computer peripheral device according to another embodiment of the present invention.
Figure 9:
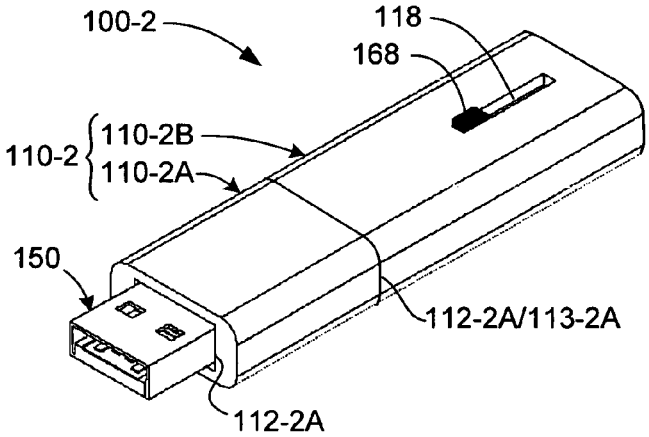
FIG. 9 is a perspective view showing the peripheral device of FIG. 8 in an open position.

FIG. 8 is an exploded perspective view showing a pen-type computer peripheral device 100-2 according to a second embodiment of the present invention. Device 100-2 includes PCBA 120 and manual positioning member 160, which are described above with reference to device 100-1. Device 100-2 differs from peripheral device 100-1 in that device 100-2 includes a two-part housing 110-2 made up of a front (first) portion 110-2A and a rear portion 110-2B. In particular, front portion 110-2A includes upper, lower, and opposing side wall sections defining a (first) front opening 112-2A and having an open rear end 113-2A, and rear portion 110-2B includes upper, lower, and opposing side wall sections defining a (second) front opening 112-2B and a closed rear end 113-2B. Similar to housing 110-1 (described above), the upper wall of rear portion 110-2B defines a slot 118, and the side walls of rear portion 110-2B define opposing positioning grooves 119A and 119B. During assembly, side edges 137A and 137B are respectively inserted into positioning grooves 119A and 119B such that the handle portion of positioning member 160 extends through slot 118 (as indicated in FIG. 9). Front portion 110-2A is then mounted onto rear portion 110-2B such that the rear end 113-2A of front portion 110-2A abuts the front end 112-2B of rear portion 110-2B (also depicted in FIG. 9). Front portion 110-2A is then secured to rear portion 110-2B by way of corresponding connecting structures (not shown), or by using an adhesive, a tight fit (e.g., snap coupling), pin-holes, ultrasonic welding, or other connecting mechanism. Once assembled, two-part housing 110-2 functions essentially as described above, with plug connector 150 extending and retracting through front end 112-2A.

Figure 10:
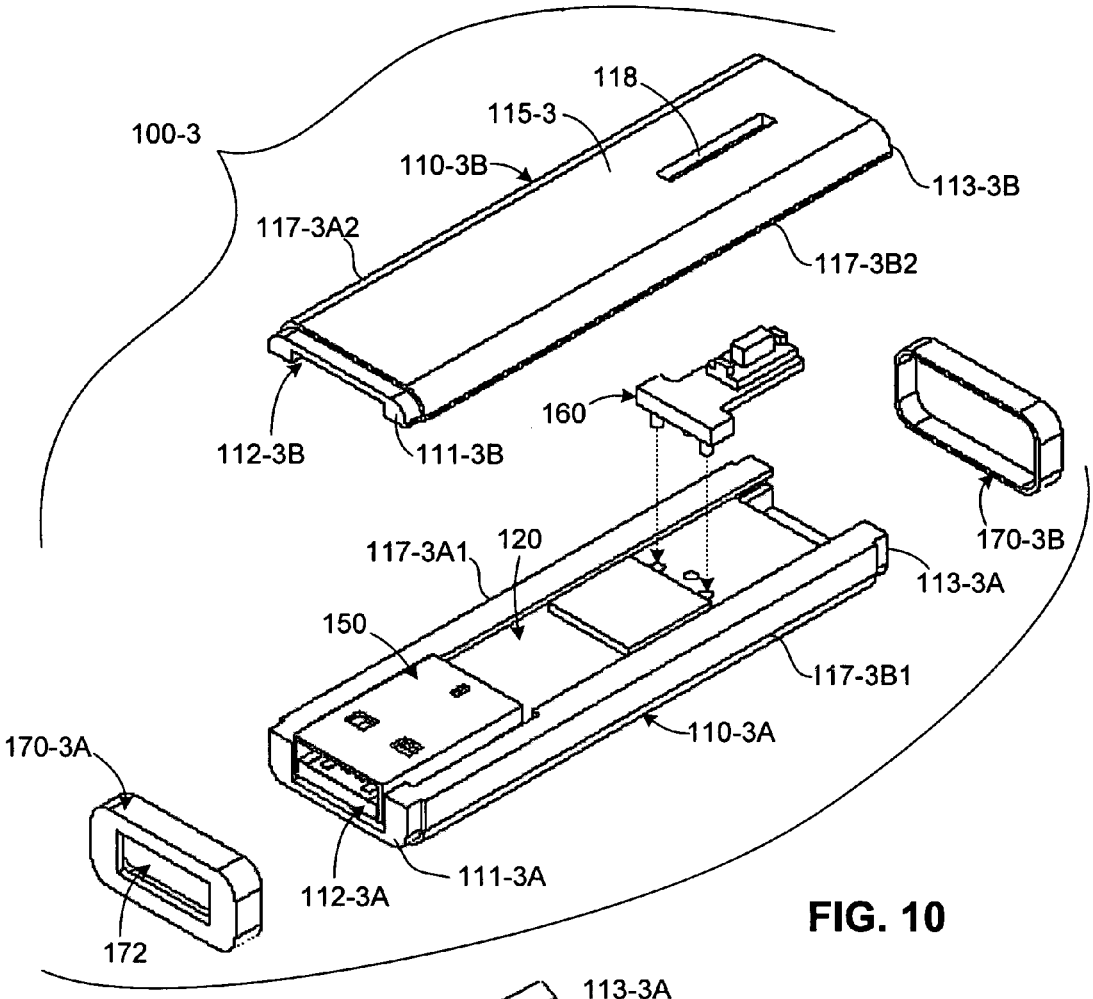
FIG. 10 is an exploded perspective view showing a pen-type computer peripheral device according to yet another embodiment of the present invention.
Figure 11:
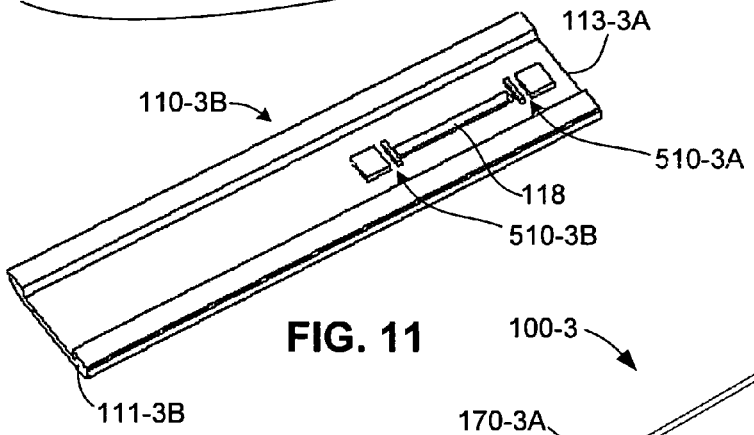
FIG. 11 is a perspective view showing the inside surface of a cover utilized in the peripheral device of FIG. 8.
Figure 12:
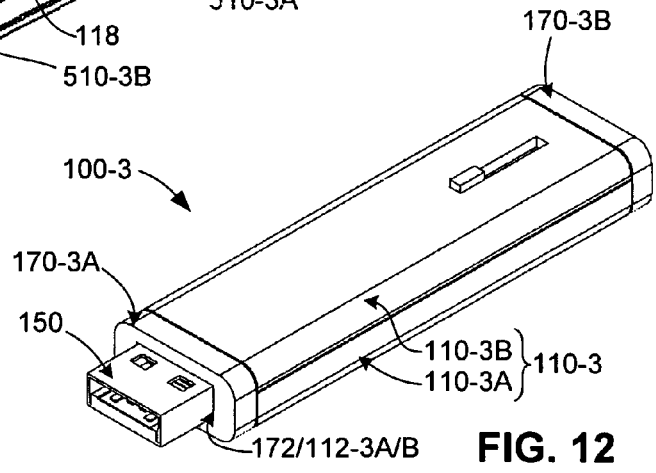
FIG. 12 is a perspective view showing the peripheral device of FIG. 10 in an open position.

FIG. 10 is an exploded perspective view showing a pen-type computer peripheral device 100-3 according to a third embodiment of the present invention. Device 100-3 includes PCBA 120 and manual positioning member 160, which are described above with reference to device 100-1. Device 100-3 differs from peripheral devices 100-1 and 100-2 in that device 100-3 includes a two-part housing 110-3 made up of a bottom (base) portion 110-3A and a top cover portion 110-3B. In particular, base portion 110-3A includes a lower wall and opposing side wall sections 117-3A1 and 117-3B1 having a front end portion 111-3A defining a (first) front opening portion 112-3A, and rear end portion 113-3A defining a rear opening. Top cover portion 110-3B includes an upper wall 115 defining slot 118, and opposing side wall sections 117-3A2 and 117-3B2 having a front end portion 111-3B defining a (second) front opening portion 112-3B, and rear end portion 113-3B defining a rear opening portion. Similar to housing 110-1 (described above), the side walls 117-3A1 and 117-3B1 of lower portion 110-3A define opposing positioning grooves that slidably receive PCBA 120. Next, top cover portion 110-3B is mounted onto base portion 110-3A such that side walls 117-3A2 and 117-3B2 are respectively connected to the upper edges of side walls 117-3A1 and 117-3B1. As indicated in FIG. 11, the inside (lower) surface of top cover 110-3B includes locking grooves 510-3A and 510-3B located at opposite ends of slot 118 that operate as described above. A pair of end caps 170-3A and 170-3B are then mounted onto the front and rear ends of the assembled housing 110-3, thereby securing base portion 110-3A and top cover 110-3B. As indicated in FIGS. 10 and 12, front cap 170-3A defines a cap opening 172 that aligns with front opening portions 112-3A and 112-3B to facilitate deployment of plug connector 150. Rear cap 170-3B mounts onto rear end portions 113-3A and 113-3B to close the (second) rear opening of housing 110-3. Once assembled, two-part housing 110-3 functions essentially as described above, with plug connector 150 extending and retracting through front end opening 112-3A/B and cap opening 172 in the manner described above.

Figures 13, 14A, 14B:
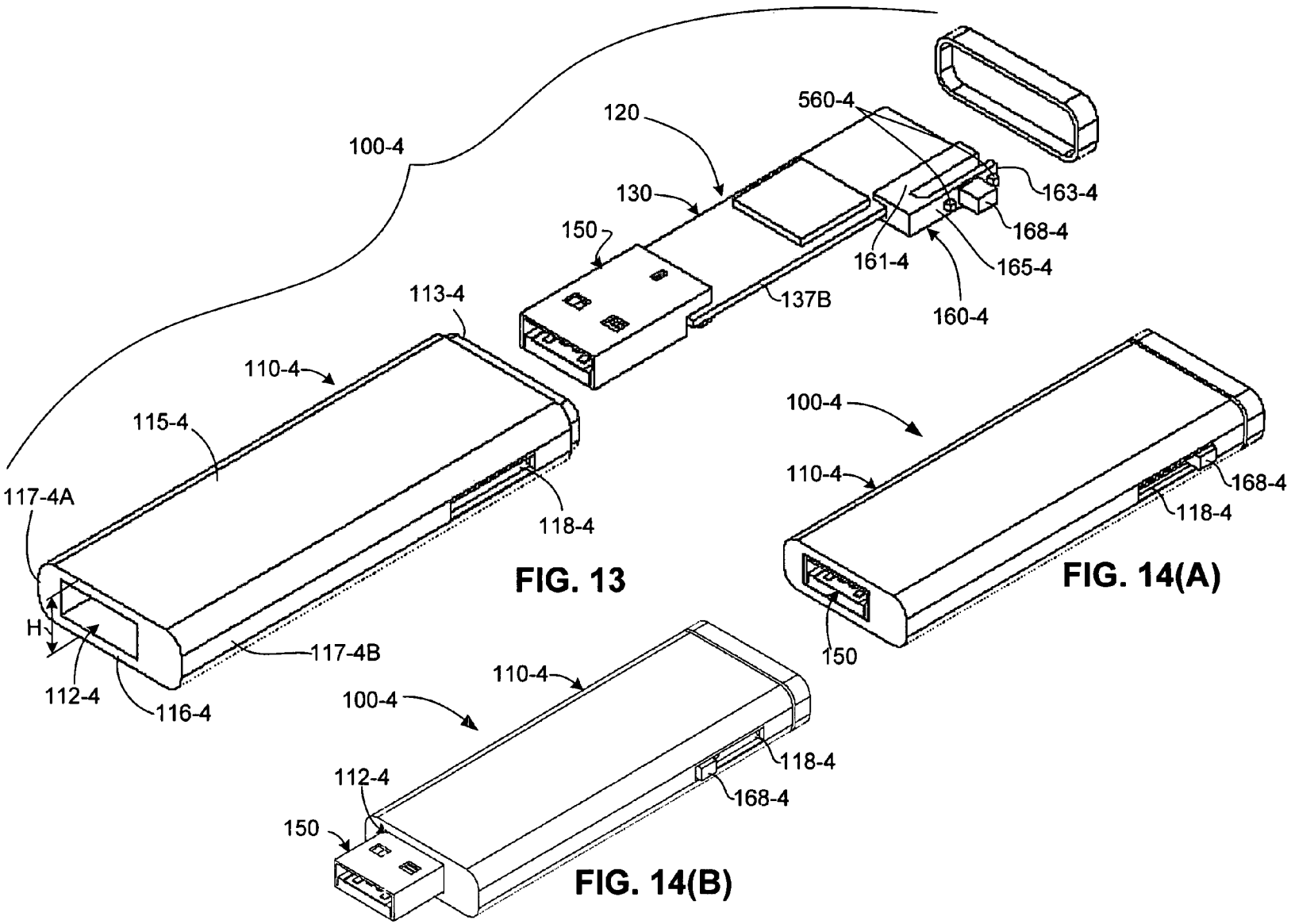
FIG. 13 is an exploded perspective view showing a pen-type computer peripheral device according to yet another embodiment of the present invention.
FIGS. 14(A) and 14(B) are perspective views showing the peripheral device of FIG. 13 in alternative closed and open positions, respectively.

FIG. 13 is an exploded perspective view showing a pen-type computer peripheral device 100-4 according to a fourth embodiment of the present invention. Device 100-4 includes PCBA 120, which is constructed essentially as described above. Device 100-4 also includes a housing 110-4 including an upper wall 115-4, a bottom wall 116-4, and opposing side walls 117-4A and 117-4B that form a rectangular cross-section in a manner similar to that described above. However, device 100-4 differs from the previously-described peripheral devices in that device 100-4 includes a slot 118-4 formed in a side wall 117-4B (i.e., instead of upper wall 115-4). In addition, device 100-4 includes a positioning member 160-4 having a base portion 161-4 mounted on side edge 137B of PCB 130, and a free end 163-4 offset from side edge 137B. Similar to the positioning members described above, positioning member 160-4 also includes a handle structure 168-4 and locking protrusions 560-4 mounted on an upper surface 165-4. As indicated in FIGS. 14(A) and 14(B), with this arrangement, handle structure 168-4 protrudes through slot 118-4 on side wall 137B, instead of upper wall 115-4, thereby allowing a flatter profile (i.e., because the vertical space required for positioning member 160-4 is reduced, housing 110-4 can be constructed such that the housing height H, measured between upper wall 115-4 and 116-4, is smaller than in the embodiments described above). Note that the positioning member 160-4 and slot 118 can be positioned on edge 137A, opposite to side 137B, with similar functioning.

Figures 15, 16A, 16B:
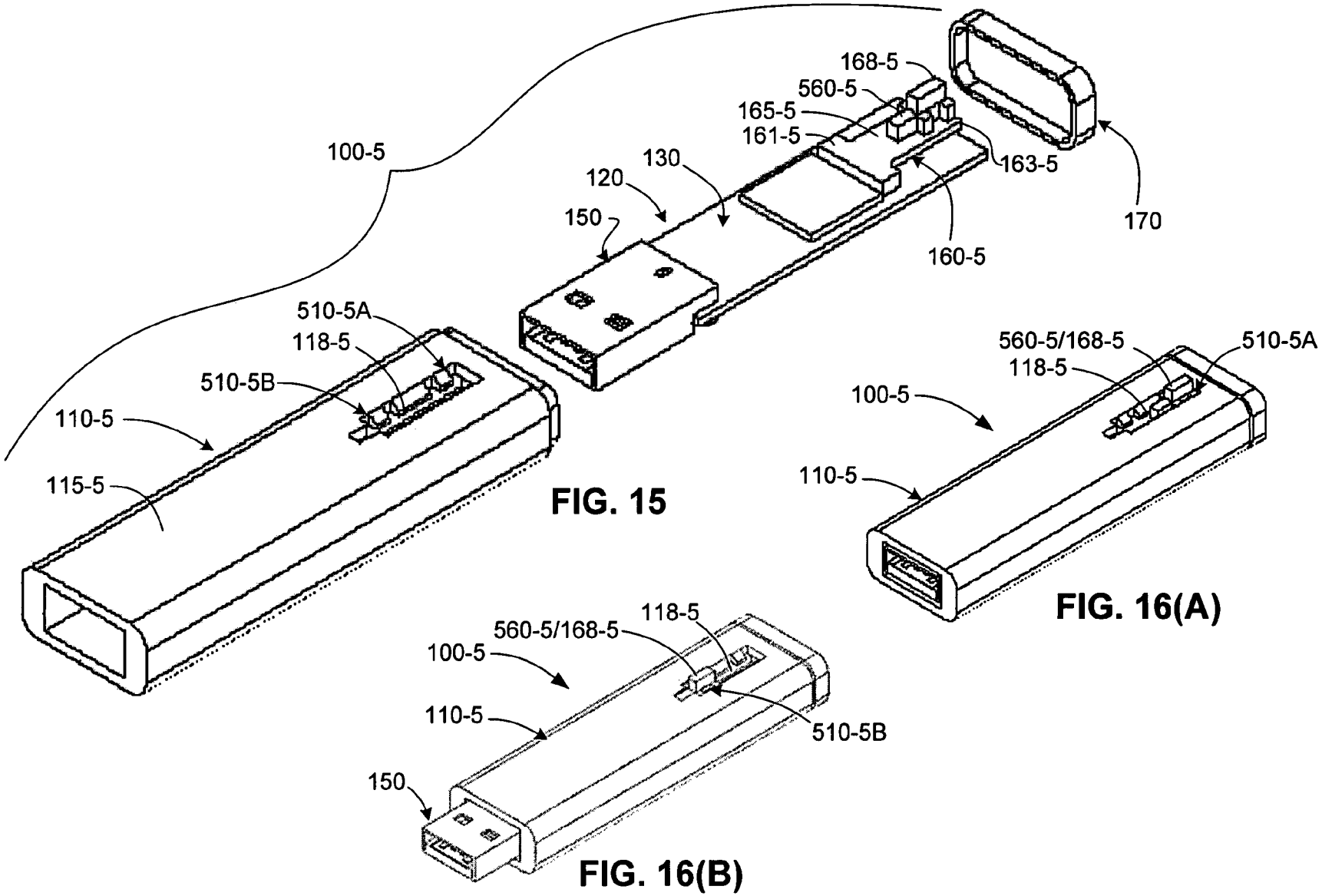
FIG. 15 is an exploded perspective view showing a pen-type computer peripheral device according to yet another embodiment of the present invention.
FIGS. 16(A) and 16(B) are perspective views showing the peripheral device of FIG. 15 in alternative closed and open positions, respectively.

FIGS. 15 through 19(B) depict a pen-type computer peripheral device 100-5 according to a fifth embodiment of the present invention. Referring to FIG. 15, device 100-5 includes PCBA 120 and positioning member 160-5, which are constructed and assembled in a manner similar to that described above, and a housing 110-5 and rear cap 170 that connect together over PCBA 120 and positioning mechanism 160-5 in a manner similar to that described above. Note that any of the above-described housing embodiments may be used in place of single-piece housing 110-5. Device 100-5 is distinguished from previous embodiments in that it includes a locking mechanism that is exposed on upper surface 115-5 of housing 110-5, as opposed to being hidden inside the housing as in the previous embodiments. While the exposed locking mechanism increases the size of the opening formed in housing 110-5, the exposed locking mechanism allows an easy method for verifying that the plug connector is secured in the retracted position, thereby avoiding unintended deployment that can result in damage to the plug connector. In addition, the exposed mechanism requires less vertical space than the hidden mechanism, thereby facilitating a reduction of the housing height because the engaging mechanism is lateral to, instead of longitudinal to, the handle structure. Finally, the visually exposed locking mechanism will make the assembly step as described in block 750 of FIG. 7 a more reliable process.

As indicated in FIG. 15, the exposed locking mechanism of the exemplary embodiment includes a substantially H-shaped protrusion 560-5 on positioning member 160-5 and two H-shaped openings 510-5A and 510-5B that are defined in upper wall 115-5 of housing 110-5. H-shaped protrusion 560-5 extends upward from upper surface 165-5 of positioning member 160-5, and is formed adjacent to free end 163-5 of positioning member 160-5. Note that handle structure 168-5 extends upward from a central portion of H-shaped protrusion 560-5, thereby facilitating positioning of plug connector 150 in a manner similar to that described above. H-shaped openings 510-5A and 510-5B are located at opposite ends of slot 118-5, which is also defined in upper wall 115-5. Similar to the embodiments described above, H-shaped protrusion 560-5 is received in the rearmost H-shaped opening 510-5A when plug connector 150 is in the retracted position (shown in FIG. 16(A)), and is then slid along slot 118-5 and received in the front-most H-shaped opening 510-5B when plug connector is manually repositioned into the deployed position (shown in FIG. 16(B)).

Figure 17A:
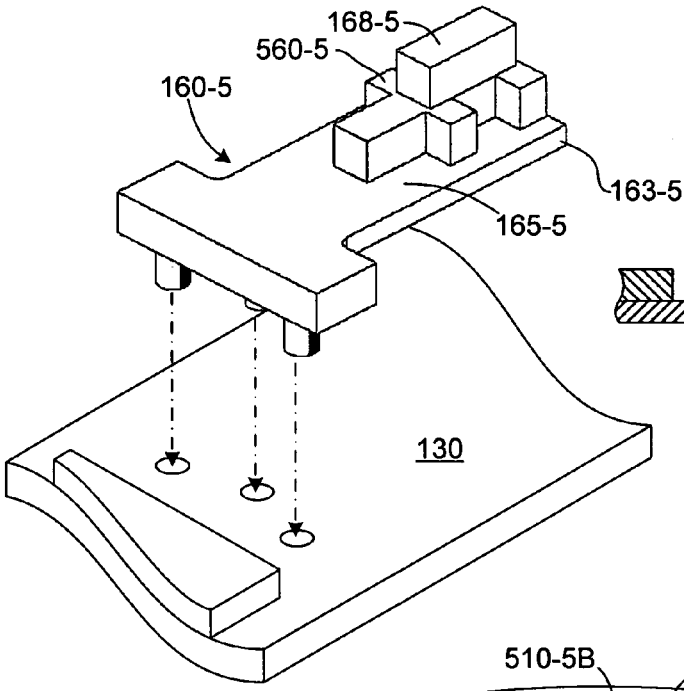
FIGS. 17(A) and 17(B) are exploded perspective and cross-sectional side views showing a cantilever-like locking member of the peripheral device of FIG. 15.
Figure 17B:
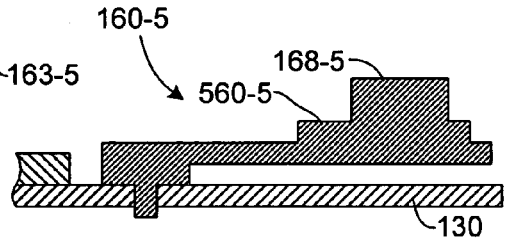

FIGS. 17(A) and 17(B) are partial exploded perspective and cross-sectional side views showing positioning member 160-5 and a portion of PCB 130, and showing in detail the position of handle structure 168-5 on H-shaped protrusion 560-5. As indicated in FIG. 17(A), positioning member 160-5 is mounted onto PCB 130 in the manner described above.

Figure 18A:
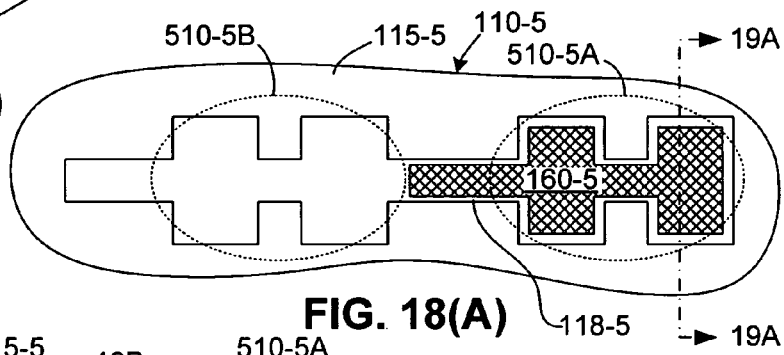
FIGS. 18(A), 18(B) and 18(C) are top views showing a portion of the peripheral device of FIG. 15 and depicting the cantilever-like locking member of FIG. 16(A) in various positions.
Figure 18B:
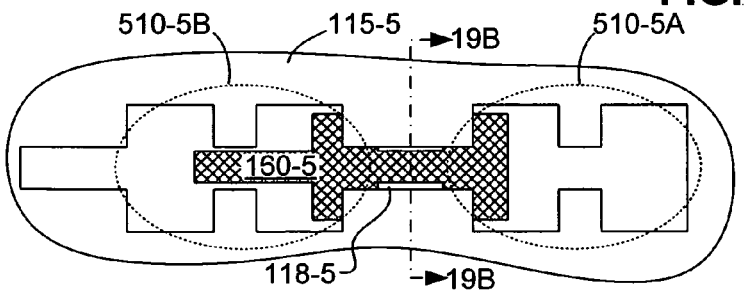
Figure 18C:
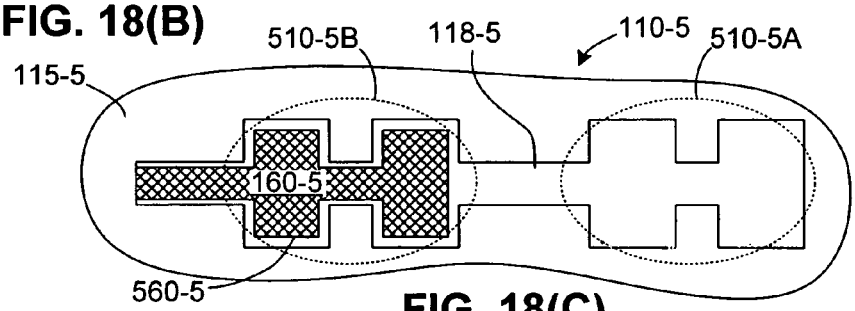

FIGS. 18(A) through 18(C) are partial top views showing a portion of upper surface 115-5 of the housing that includes slot 118-5 and H-shaped openings 510-5A and 510-5B. As indicated in FIG. 18(A), when positioning member 160-5 is located adjacent to the rear end of housing 110-5, H-shaped protrusion 560-5 enters H-shaped opening 510-5A. FIG. 18(B) shows positioning member 160-5 in an intermediate position between H-shaped openings 510-5A and 510-5B during transition from the retracted to the deployed positions (or from deployed to retracted). FIG. 18(C) shows positioning member 160-5 in the fully deployed position, in which H-shaped protrusion 560-5 enters H-shaped opening 510-5B.

Figure 19A:
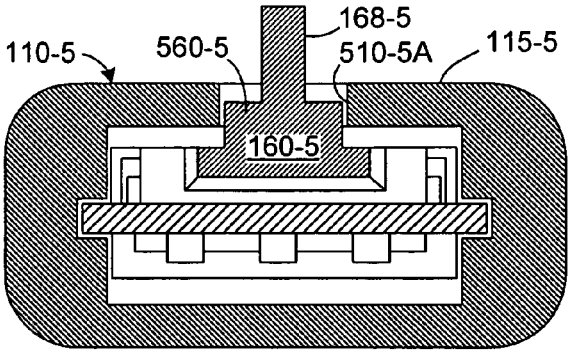
FIGS. 19(A) and 19(B) are cross-sectional end views showing the peripheral device of FIG. 15 and depicting the cantilever locking member of FIG. 16(A) in various positions.
Figure 19B:
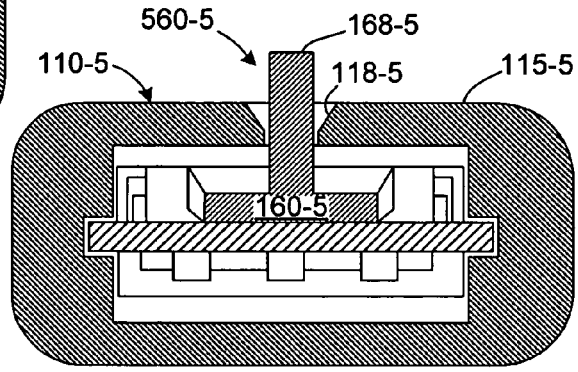

FIGS. 19(A) and 19(B) are cross-sectional end views taken along section lines 19A—19A and 19B—19B of FIGS. 18(A) and 18(B), respectively. As indicated in FIG. 19(A), when positioning member 160-5 is located in the retracted positions, handle structure 168-5 extends well above upper wall 115-5, and H-shaped protrusion 560-5 is engaged in H-shaped opening 510-5A, thereby preventing unintended movement of positioning member 160-5 out of the retracted position. As indicated in FIG. 19(B), during transition from the retracted to the deployed positions, handle structure 168-5 is pressed down into housing 110-5 such that the H-shaped protrusion is located below an inside surface of upper wall 115-5, thereby facilitating sliding movement of positioning member 160-5 along slot 118-5. Note that, in accordance with another aspect, slot 118-5 can be V-shaped to facilitate manual pressing and sliding of handle structure 168-5.

Figure 20A:
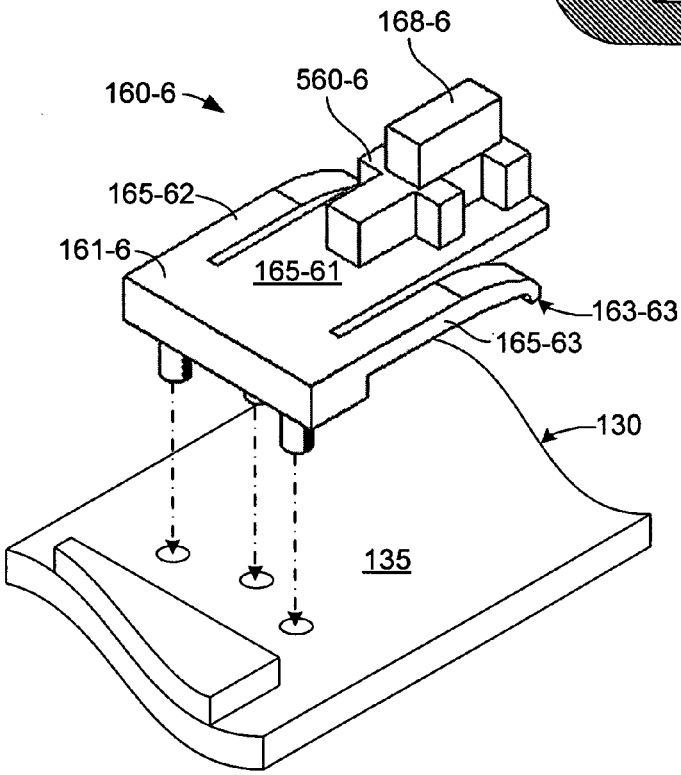
FIGS. 20(A) and 20(B) are exploded perspective and cross-sectional side views showing a cantilever locking member according to another embodiment of the present invention.
Figure 20B:
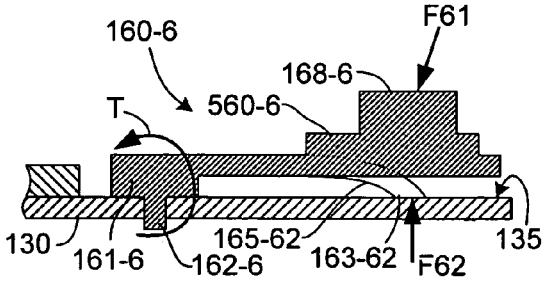

FIGS. 20(A) and 20(B) are exploded perspective and cross-sectional side views showing a positioning member 160-6 according to yet another alternative embodiment of the present invention that can be utilize in any of the embodiments described above. Positioning member 160-6, which like in previous embodiments is molded from a flexible material such as thermal plastic, includes a base portion 161-6 that is mounted onto PCB 130 in the manner described above, a central section 165-61, and a pair of curved support members 165-62 and 165-63. Central section 165-61 extends from base 161-6 substantially parallel to the upper surface of PCB 130, and includes a locking member 560-6 and handle structure 168-6 according to any of the embodiments described above. Curved support members 165-62 and 165-63 have a first end portion extending from base 161-6 in a direction parallel to central section 165-61, and curve downward such that free end portions (e.g., free end portion 163-62, as shown in FIG. 20(B)) respectively contact upper surface 135 of PCB 130. The benefit of this arrangement is that, as indicated in FIG. 20(B), when a push-slide force F61 is applied to handle structure 168-6, a portion of the downward force component is countered by a resistive force F62 applied by curved support members 165-62 and 165-63 against the PCB, thereby minimizing the torque T applied by base 161-6 on PCB 130 (as opposed to the pure cantilever-like structures of the previous embodiments, wherein the torque T must alone balance the entire press-sliding force). Thus, curved support members 165-62 and 165-63 support the fabrication of peripheral devices using thinner, less rigid PCBs 130, and allow the use of smaller posts 162-6 for connecting positioning member 160-6 to PCB 130.

Figure 21:
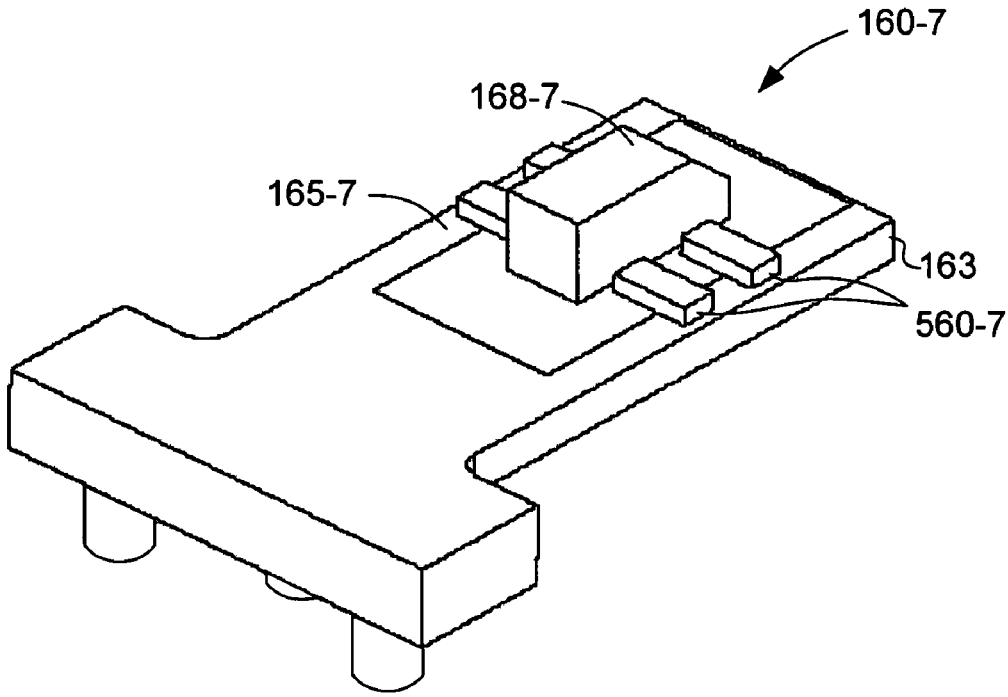
FIG. 21 is a perspective view showing a cantilever locking member according to another embodiment of the present invention.
Figure 22:
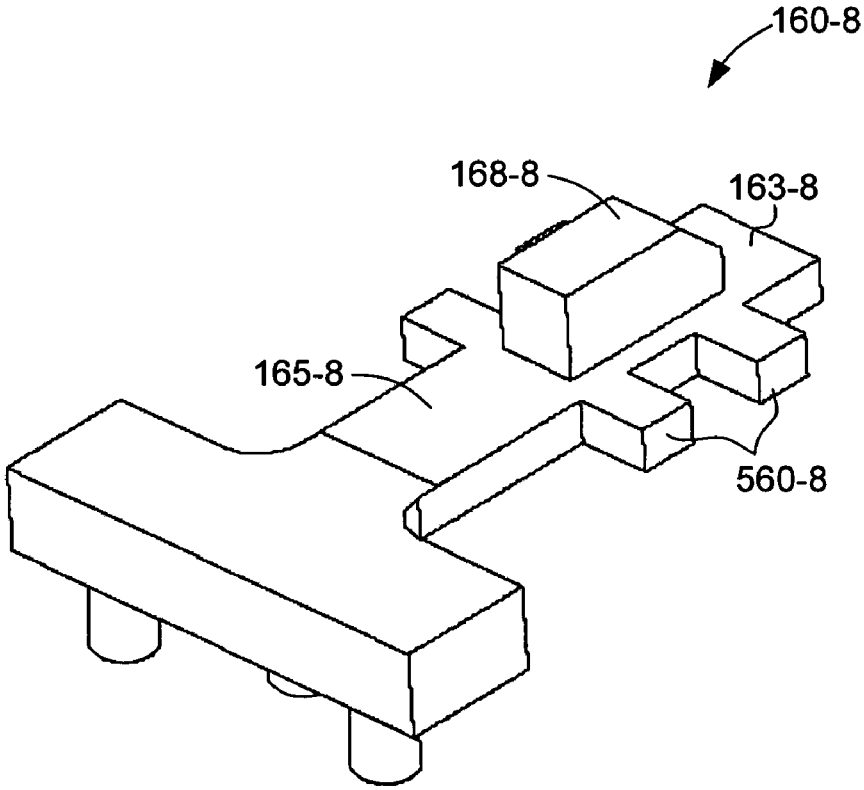
FIG. 22 is a perspective view showing a cantilever locking member according to yet another embodiment of the present invention.

In addition to the exemplary embodiments described above, the locking protrusions may be located next to the handle structure or even formed by the cantilever structure from which the handle structure extends. For example, FIG. 21 shows a positioning member 160-7 in which legs forming a generally H-shaped protrusion 560-7 and a handle structure 168-7 are formed on an upper surface 165-7, with the legs of the H-shaped protrusion 560-7 extending from the sides of handle structure 168-7. As a result, the corresponding locking grooves (i.e., corresponding to grooves 510-5A and 510-5B in FIGS. 18(A)–18(C)) will be simplified as locking strip (not shown), and locking engagement will be accomplished when the locking strip in the housing is received in the locking structure in the positioning member. In yet another exemplary embodiment shown in FIG. 22, an H-shaped key structure 560-8 is integrally formed adjacent to a free end 163-8 of a cantilever-like positioning member 160-8, with a handle structure 168-8 extending from a region of upper surface 165-8 that is located in the center of H-shaped key structure 560-8, thus producing a slender positioning member 160-8 with the key structure to be engaged with a corresponding locking structure formed on the inside surface of the housing (not shown) in a manner similar to that described above. The key structure facilitates elimination of the step-like protrusion structure, which is placed on the top surface of the positioning member in earlier embodiments, thereby providing a design with smaller overall height of the apparatus.

While the present invention has been described above with reference to several specific embodiments, these embodiments are intended to be exemplary and not limiting. For example, although the described embodiments include an IC, a plug connector, and a positioning member mounted on a PCB, in another embodiment a rigid substrate may be utilized to support only the plug connector and the positioning member, with the IC (or other electronic device) mounted separately in the housing and coupled to the plug connector by, for example, a flexible cable. In addition, although the disclosed embodiments describe a PCB slidably engaged in grooves formed in the housing, the PCB can be fixedly attached to a carrier or boat (e.g., via pins), with the carrier slidably mounted inside of the housing.

What is claimed is:

1. A portable computer peripheral apparatus comprising:

an elongated housing having an end portion defining an opening;

at least one electronic device mounted inside of the housing;

a plug connector movably connected to the housing and electronically connected to said at least one electronic device; and means for manually moving the plug connector between a first position, in which the plug connector is positioned inside of the housing, and a second position in which the plug connector extends through the opening and is exposed outside of the housing, wherein the plug connector is mounted onto a substrate, wherein the positioning member comprises a cantilever structure including a fixed end fixedly attached to the substrate, and a free end spaced from the substrate, wherein a handle structure is fixedly mounted adjacent to the free end of the positioning member, wherein the positioning member further comprises a first locking structure mounted adjacent to the handle structure, wherein the housing further comprises a second locking structure located adjacent to a first end of the slot, and a third locking structure located adjacent to a second end of the slot, and wherein the positioning member is mounted in the housing such that the first locking structure engages the second locking structure when the plug connector is in the first position, and such that the first locking structure engages the third locking structure when the plug connector is in the second position.

2. The apparatus of claim 1, wherein the second and third locking structures are located on an inside surface of the housing.

3. The apparatus of claim 1, wherein the first locking structure comprises an H-shaped protrusion, and the handle structure extends from the H-shaped protrusion, wherein the second and third locking structures comprise first and second H-shaped openings respectively defined at opposite ends of the slot, and wherein the positioning member is mounted in the housing such that the H-shaped protrusion is received in the first H-shaped opening when the plug connector is in the first position, and such that the H-shaped protrusion is received in the second H-shaped opening when the plug connector is in the second position.

4. The apparatus of claim 1, wherein the first locking structure comprises a plurality of legs located on sides of the handle structure, wherein the second and third locking structures comprise first and second openings respectively defined at opposite ends of the slot, and wherein the positioning member is mounted in the housing such that the first locking structure is received in the first opening when the plug connector is in the first position, and such that the first locking structure is received in the second opening when the plug connector is in the second position.

5. The apparatus of claim 1, wherein the first locking structure comprises an H-shaped key structure including plurality of legs extending from sides of the positioning member adjacent to the free end.

6. A portable computer peripheral apparatus comprising:

an elongated housing having an end portion defining an opening;

at least one electronic device mounted inside of the housing;

a plug connector movably connected to the housing and electronically connected to said at least one electronic device; and means for manually moving the plug connector between a first position, in which the plug connector is positioned inside of the housing, and a second position in which the plug connector extends through the opening and is exposed outside of the housing, wherein the plug connector is mounted onto a substrate, wherein the positioning member comprises a cantilever structure including a fixed end fixedly attached to the substrate, and a free end spaced from the substrate, wherein a handle structure is fixedly mounted adjacent to the free end of the positioning member, wherein the positioning member further comprises a curved support member having a first end fixedly attached to the fixed end of the cantilever structure, and a second end contacting the substrate at a point adjacent to the free end of the cantilever structure.

7. A portable computer peripheral apparatus comprising:

an elongated housing having an end portion defining an opening;

at least one electronic device mounted inside of the housing;

a plug connector movably connected to the housing and electronically connected to said at least one electronic device;

means for manually moving the plug connector between a first position, in which the plug connector is positioned inside of the housing, and a second position in which the plug connector extends through the opening and is exposed outside of the housing; and a printed circuit board (PCB) movably mounted inside of the housing, wherein the plug connector is attached to a first end of the PCB, and wherein the electronic device comprises an integrated circuit (IC) mounted onto a surface of the PCB, wherein said means comprises a positioning member including a fixed end fixedly attached to the PCB, a free end spaced from the PCB, and a handle structure fixedly mounted adjacent to the free end, wherein the housing defines a slot, wherein the positioning member is mounted in the housing such that a portion of the handle structure extends through the slot and is exposed outside of the housing, wherein the positioning member further comprises a first locking structure mounted adjacent to the handle structure, wherein the housing further comprises a second locking structure located adjacent to a first end of the slot, and a third locking structure located adjacent to a second end of the slot, and wherein the positioning member is mounted in the housing such that the first locking structure engages the second locking structure when the plug connector is in the first position, and such that the first locking structure engages the third locking structure when the plug connector is in the second position.

8. A portable computer peripheral apparatus comprising:

an elongated housing having an end portion defining an opening;

at least one electronic device mounted inside of the housing;

a plug connector movably connected to the housing and electronically connected to said at least one electronic device; and means for manually moving the plug connector between a first position, in which the plug connector is positioned inside of the housing, and a second position in which the plug connector extends through the opening and is exposed outside of the housing, wherein the housing comprises an elongated upper wall, an elongated lower wall, and a pair of elongated side walls extending between the upper and lower walls such that the upper, lower, and side walls form a generally rectangular cross-section, wherein the end portion of the housing is located at a first end of the upper, lower, and side walls, wherein the housing defines a second opening located at a second end of the upper, lower, and side walls, and wherein the apparatus further comprises a cap attached to the housing over the second opening.

9. A portable computer peripheral apparatus comprising:

an elongated housing having an end portion defining an opening;

at least one electronic device mounted inside of the housing;

a plug connector movably connected to the housing and electronically connected to said at least one electronic device; and means for manually moving the plug connector between a first position, in which the plug connector is positioned inside of the housing, and a second position in which the plug connector extends through the opening and is exposed outside of the housing, wherein the housing comprises an elongated upper wall, an elongated lower wall, and a pair of elongated side walls extending between the upper and lower walls such that the upper, lower, and side walls form a generally rectangular cross-section, wherein the end portion of the housing is located at a first end of the upper, lower, and side walls, and wherein the housing comprises:

a first portion including first sections of the upper, lower, and side walls; and a second portion connected to the first portion and including second sections of the upper, lower, and side walls.

10. A portable computer peripheral apparatus comprising:

an elongated housing having an end portion defining an opening;

at least one electronic device mounted inside of the housing;

a plug connector movably connected to the housing and electronically connected to said at least one electronic device; and means for manually moving the plug connector between a first position, in which the plug connector is positioned inside of the housing, and a second position in which the plug connector extends through the opening and is exposed outside of the housing, wherein the housing comprises an elongated upper wall, an elongated lower wall, and a pair of elongated side walls extending between the upper and lower walls such that the upper, lower, and side walls form a generally rectangular cross-section, wherein the end portion of the housing is located at a first end of the upper, lower, and side walls, and wherein the housing comprises:

a base portion including the lower wall and at least a portion of the side walls; and a cover portion mounted onto upper edges of the side walls, wherein the cover portion includes the upper wall of the housing and defines a slot.

11. The apparatus of claim 10, further comprising:

a first end cap mounted over a first end opening defined by the base portion and the cover portion, wherein the first end cap defines a cap opening arranged such that the plug connector extends through the cap opening when the plug connector is in the second position; and a second end cap mounted over a second end opening defined by the base portion and the cover portion.

12. A portable computer peripheral apparatus comprising:

a housing including a plurality of walls defining an elongated chamber extending in a longitudinal direction, wherein one wall of the plurality of walls defines a slot extending in the longitudinal direction, and wherein the housing defines a first opening at a first end of the elongated chamber;

a printed circuit board assembly (PCBA) mounted inside the housing such that the PCBA is movable in the longitudinal direction, the PCBA including a printed circuit board (PCB) and a plug connector mounted onto an end of the PCB; and a positioning member connected to the printed circuit board and including a handle structure extending through the slot formed in the housing, whereby the positioning member facilitates manual positioning of the PCBA between a first position, in which the plug connector is positioned inside of the housing, and a second position in which the plug connector extends through the first opening and is exposed outside of the housing, wherein opposing side walls of the housing define grooves, and wherein opposing side edges of the PCB are slidably received in the grooves.

13. A portable computer peripheral apparatus comprising:

a housing including a plurality of walls defining an elongated chamber extending in a longitudinal direction, wherein one wall of the plurality of walls defines a slot extending in the longitudinal direction, and wherein the housing defines a first opening at a first end of the elongated chamber;

a printed circuit board assembly (PCBA) mounted inside the housing such that the PCBA is movable in the longitudinal direction, the PCBA including a printed circuit board (PCB) and a plug connector mounted onto an end of the PCB; and a positioning member connected to the printed circuit board and including a handle structure extending through the slot formed in the housing, whereby the positioning member facilitates manual positioning of the PCBA between a first position, in which the plug connector is positioned inside of the housing, and a second position in which the plug connector extends through the first opening and is exposed outside of the housing, wherein the PCB is fixedly attached to a carrier that is slidably mounted inside of the housing.

14. A portable computer peripheral apparatus comprising:

a housing including a plurality of walls defining an elongated chamber extending in a longitudinal direction, wherein one wall of the plurality of walls defines a slot extending in the longitudinal direction, and wherein the housing defines a first opening at a first end of the elongated chamber;

a printed circuit board assembly (PCBA) mounted inside the housing such that the PCBA is movable in the longitudinal direction, the PCBA including a printed circuit board (PCB) and a plug connector mounted onto an end of the PCB; and a positioning member connected to the printed circuit board and including a handle structure extending through the slot formed in the housing, whereby the positioning member facilitates manual positioning of the PCBA between a first position, in which the plug connector is positioned inside of the housing, and a second position in which the plug connector extends through the first opening and is exposed outside of the housing, wherein the positioning member further comprises a first locking structure mounted adjacent to the handle structure, wherein the wall of the housing that defines the slot further comprises a second locking structure located adjacent to a first end of the slot, and a third locking structure located adjacent to a second end of the slot, and wherein the positioning member is mounted in the housing such that the first locking structure engages the second locking structure when the plug connector is in the first position, and such that the first locking structure engages the third locking structure when the plug connector is in the second position.

15. A portable computer peripheral apparatus comprising:

a housing including a plurality of walls defining an elongated chamber extending in a longitudinal direction, wherein one wall of the plurality of walls defines a slot extending in the longitudinal direction, and wherein the housing defines a first opening at a first end of the elongated chamber;

a printed circuit board assembly (PCBA) mounted inside the housing such that the PCBA is movable in the longitudinal direction, the PCBA including a printed circuit board (PCB) and a plug connector mounted onto an end of the PCB; and a positioning member connected to the printed circuit board and including a handle structure extending through the slot formed in the housing, whereby the positioning member facilitates manual positioning of the PCBA between a first position, in which the plug connector is positioned inside of the housing, and a second position in which the plug connector extends through the first opening and is exposed outside of the housing, wherein the housing comprises an elongated upper wall, an elongated lower wall, and a pair of elongated side walls extending between the upper and lower walls such that the upper, lower, and side walls form a generally rectangular cross-section, wherein the end portion of the housing is located at a first end of the upper, lower, and side walls, wherein the housing defines a second opening located at a second end of the upper, lower, and side walls such that the elongated chamber extends between the first and second openings, and wherein the apparatus further comprises a cap attached to the housing over the second opening.

16. A portable computer peripheral apparatus comprising:

a housing including a plurality of walls defining an elongated chamber extending in a longitudinal direction, wherein one wall of the plurality of walls defines a slot extending in the longitudinal direction, and wherein the housing defines a first opening at a first end of the elongated chamber;

a printed circuit board assembly (PCBA) mounted inside the housing such that the PCBA is movable in the longitudinal direction, the PCBA including a printed circuit board (PCB) and a plug connector mounted onto an end of the PCB; and a positioning member connected to the printed circuit board and including a handle structure extending through the slot formed in the housing, whereby the positioning member facilitates manual positioning of the PCBA between a first position, in which the plug connector is positioned inside of the housing, and a second position in which the plug connector extends through the first opening and is exposed outside of the housing, wherein the housing comprises an elongated upper wall, an elongated lower wall, and a pair of elongated side walls extending between the upper and lower walls such that the upper, lower, and side walls form a generally rectangular cross-section, wherein the end portion of the housing is located at a first end of the upper, lower, and side walls, and wherein the housing comprises:

a first portion including first sections of the upper, lower, and side walls; and a second portion connected to the first portion and including second sections of the upper, lower, and side walls.

17. A portable computer peripheral apparatus comprising:

a housing including a plurality of walls defining an elongated chamber extending in a longitudinal direction, wherein one wall of the plurality of walls defines a slot extending in the longitudinal direction, and wherein the housing defines a first opening at a first end of the elongated chamber;

a printed circuit board assembly (PCBA) mounted inside the housing such that the PCBA is movable in the longitudinal direction, the PCBA including a printed circuit board (PCB) and a plug connector mounted onto an end of the PCB; and a positioning member connected to the printed circuit board and including a handle structure extending through the slot formed in the housing, whereby the positioning member facilitates manual positioning of the PCBA between a first position, in which the plug connector is positioned inside of the housing, and a second position in which the plug connector extends through the first opening and is exposed outside of the housing, wherein the housing comprises an elongated upper wall, an elongated lower wall, and a pair of elongated side walls extending between the upper and lower walls such that the upper, lower, and side walls form a generally rectangular cross-section, wherein the end portion of the housing is located at a first end of the upper, lower, and side walls, and wherein the housing comprises:

a base portion including the lower wall and at least a portion of the side walls; and a cover portion mounted onto upper edges of the side walls, wherein the cover portion includes the upper wall of the housing and defines the slot.

18. A portable computer peripheral apparatus comprising:

a housing including a plurality of walls defining an elongated chamber extending in a longitudinal direction, wherein one wall of the plurality of walls defines a slot extending in the longitudinal direction, and wherein the housing defines a first opening at a first end of the elongated chamber;

a printed circuit board assembly (PCBA) mounted inside the housing such that the PCBA is movable in the longitudinal direction, the PCBA including a printed circuit board (PCB) and a plug connector mounted onto an end of the PCB; and a positioning member connected to the printed circuit board and including a handle structure extending through the slot formed in the housing, whereby the positioning member facilitates manual positioning of the PCBA between a first position, in which the plug connector is positioned inside of the housing, and a second position in which the plug connector extends through the first opening and is exposed outside of the housing, wherein the housing comprises an elongated upper wall, an elongated lower wall, and a pair of elongated side walls extending between the upper and lower walls such that the upper, lower, and side walls form a generally rectangular cross-section, wherein the end portion of the housing is located at a first end of the upper, lower, and side walls, and said apparatus further comprising:

a first end cap mounted over a first end opening defined by the base portion and the cover portion, wherein the first end cap defines the opening; and a second end cap mounted over a second end opening defined by the base portion and the cover portion.

* * * * *